US009103301B2

(12) United States Patent
Garrison

(10) Patent No.: US 9,103,301 B2
(45) Date of Patent: Aug. 11, 2015

(54) EXHAUST GAS RECIRCULATION SYSTEM FOR A MOTORCYCLE ENGINE

(71) Applicant: Midwest Motorcycle Supply Distributors Corp., Pevely, MO (US)

(72) Inventor: John M. Garrison, Pevely, MO (US)

(73) Assignee: Midwest Motorcycle Supply Distributors Corp., Pevely, MO (US)

( * ) Notice: Subject to any disclaimer, the term of this patent is extended or adjusted under 35 U.S.C. 154(b) by 0 days.

(21) Appl. No.: 13/948,909

(22) Filed: Jul. 23, 2013

(65) Prior Publication Data

US 2015/0027390 A1 Jan. 29, 2015

(51) Int. Cl.

| | |
|---|---|
| ***F02F 1/06*** | (2006.01) |
| ***F02M 25/07*** | (2006.01) |
| *F02M 35/16* | (2006.01) |
| *F02F 1/30* | (2006.01) |

(52) U.S. Cl.

CPC ..... *F02M 25/0747* (2013.01); *F02F 1/30* (2013.01); *F02M 25/0703* (2013.01); *F02M 35/162* (2013.01)

(58) Field of Classification Search

CPC .... F02M 25/0703; F02M 35/162; F02M 1/30
USPC ..... 123/41.69
See application file for complete search history.

(56) References Cited

U.S. PATENT DOCUMENTS

| | | | | |
|---|---|---|---|---|
| 5,269,283 | A | 12/1993 | Thompson | |
| 5,329,912 | A * | 7/1994 | Matsumoto et al. | 123/308 |
| 5,421,292 | A | 6/1995 | Hoffman et al. | |
| 5,957,116 | A * | 9/1999 | Haegele et al. | 123/568.12 |
| 6,138,625 | A * | 10/2000 | Garrison | 123/90.39 |
| 6,289,883 | B1 * | 9/2001 | Wakutani et al. | 123/568.21 |
| 6,321,716 | B1 | 11/2001 | Mashiki et al. | |
| 6,626,134 | B1 * | 9/2003 | Brinton | 123/41.56 |
| 6,935,321 | B1 * | 8/2005 | Sullivan et al. | 123/568.18 |
| 6,945,237 | B1 * | 9/2005 | Sullivan et al. | 123/568.17 |
| 6,971,378 | B2 * | 12/2005 | Mackey et al. | 123/568.13 |
| 2002/0053343 | A1 * | 5/2002 | Sato et al. | 123/568.16 |
| 2006/0000458 | A1 * | 1/2006 | Dees et al. | 123/572 |
| 2007/0034174 | A1 * | 2/2007 | Lee | 123/41.69 |
| 2008/0083398 | A1 * | 4/2008 | Reichardt et al. | 123/572 |
| 2009/0020263 | A1 | 1/2009 | Ohsawa et al. | |
| 2009/0235654 | A1 | 9/2009 | Kobayashi et al. | |

* cited by examiner

*Primary Examiner* — Hung Q Nguyen
*Assistant Examiner* — James Kim
(74) *Attorney, Agent, or Firm* — Thompson Coburn LLP

(57) ABSTRACT

An EGR gas passageway member is removably attached to a motorcycle cylinder assembly between the cylinder head and the cylinder of said motorcycle cylinder assembly in manner such that presence of the EGR gas passageway member is partially concealed. The EGR gas passageway member allows motorcycles to be provided with EGR systems without significantly impacting the aesthetic appearance of the engines of such motorcycles.

11 Claims, 5 Drawing Sheets

FIG. 4
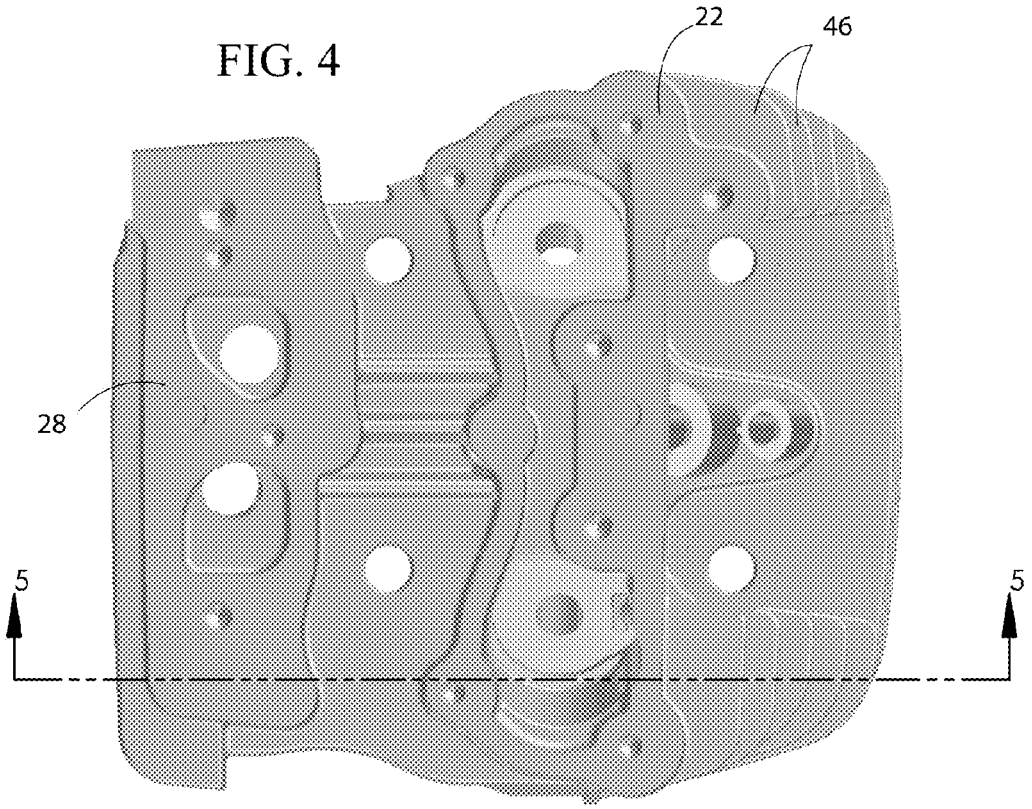
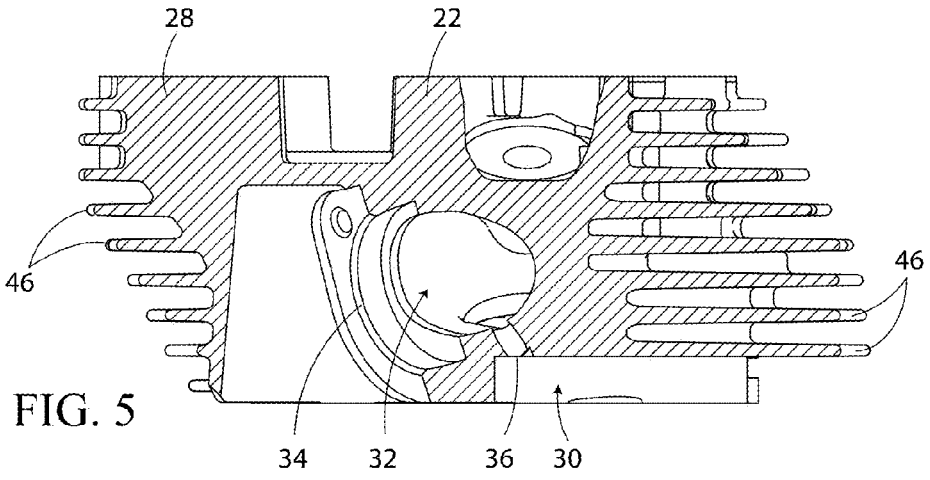
FIG. 5

EXHAUST GAS RECIRCULATION SYSTEM FOR A MOTORCYCLE ENGINE

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention relates generally to motorcycles. More particularly, the invention pertains to an exhaust gas recirculation (EGR) system for a motorcycle engine.

2. General Background

A typical motorcycle comprises an exposed engine and, in many cases, the engine is the primary visual focal point of a motorcycle. As such, aesthetics is typically a primary concern in design of a motorcycle engine. For that reason, almost every part of a motorcycle engine, from the intake manifold to the exhaust system, is configured to be visually appealing. Nonetheless, motorcycle engines necessarily must comprise key components to operate, which in some cases negatively impact the aesthetics of the motorcycle engines. For this reason, motorcycle designers and owners often avoid adding beneficial, but unnecessary, components and systems to motorcycle engines.

An example of a beneficial, but non-critical, engine component is an EGR system. EGR systems reduce nitrogen oxide emissions by recirculating a portion of the exhaust gases into the intake system. The recirculated exhaust gases increase the specific heat capacity of the gases flowing into combustion chambers and thereby reduce combustion temperature. Reduced combustion temperature reduces nitrogen oxide production. Most modern EGR systems comprise an EGR valve, which controls the amount and timing of exhaust gas recirculation such that the impact of EGR systems on engine performance is virtually negligible.

Despite the benefits of EGR systems in reducing harmful emissions, most motorcycle engines lack such systems due to the negative impact such systems can have on the overall aesthetics of motorcycle engines. This is because EGR systems typically comprise tubing that is external to the cylinder heads for channeling exhaust gases from the exhaust system and to the intake system. Such tubing is often seen as being aesthetically unpleasing.

Despite the aesthetically unpleasing nature of EGR systems, increasing emission standards makes such systems more desirable. This is particularly true for carbureted engines, which tend to have worse emissions as compared to fuel injected engines.

SUMMARY OF THE INVENTION

The present invention provides a means for incorporating EGR systems into motorcycle engines without significantly impacting the aesthetic appearance of such engines.

In a first aspect of the invention, a motorcycle cylinder head comprises a plurality of aluminum alloy air cooling fins and an EGR gas passageway. The EGR gas passageway is substantially surrounded by an alloy having higher heat resistance than said aluminum alloy and the EGR gas passageway is at least substantially concealed such that the presence of the EGR gas passageway is not readily apparent.

Another aspect of the invention pertains to an EGR gas passageway member. The EGR gas passageway member comprises at least one air cooling fin and an EGR gas passageway. The EGR gas passageway member is configured and adapted to be removably fixed to a motorcycle cylinder assembly comprising a cylinder and a cylinder head. The air cooling fin of the EGR gas passageway member is configured and adapted to at least partially conceal the presence of the EGR gas passageway member.

In yet another aspect of the invention, a motorcycle cylinder assembly comprises a cylinder head, a cylinder, and an EGR gas passageway member. The cylinder head is removably attached to the cylinder and the EGR gas passageway member is removably attached to the motorcycle cylinder assembly between the cylinder head and the cylinder.

Further features and advantages of the present invention, as well as the operation of the invention, are described in detail below with reference to the accompanying drawings.

BRIEF DESCRIPTION OF THE DRAWINGS

FIG. 4 is a top view of the cylinder head of the cylinder assembly shown in FIGS. 1-3, without the EGR gas passageway member.

FIG. 5 is a cross-sectional view of the cylinder head shown in FIG. 4, taken about the line 5-5 shown in FIG. 4.

Figure 1:
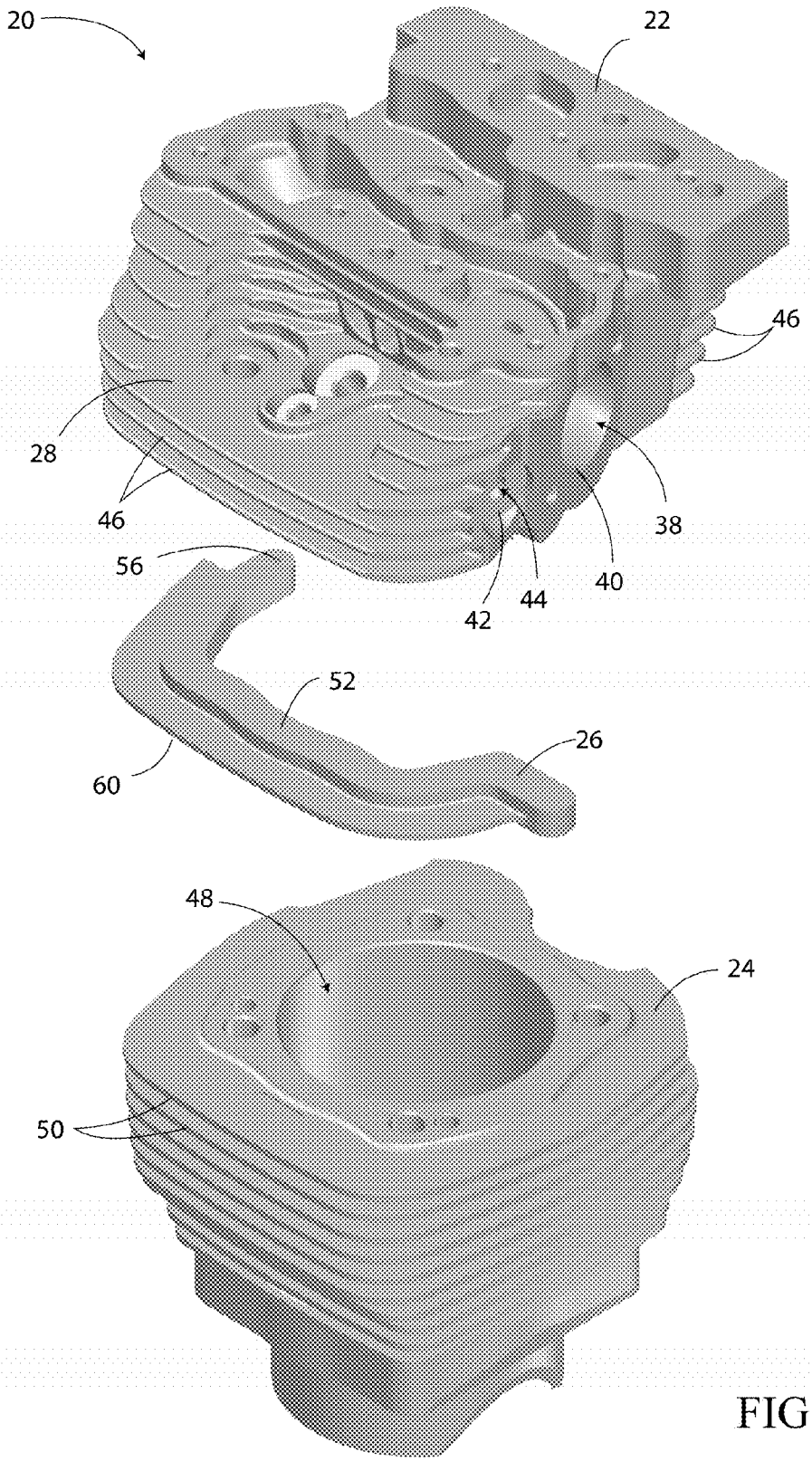
FIG. 1 is an assembly view of an embodiment of a cylinder assembly comprising the invention as viewed in perspective from above the cylinder assembly.

Reference numerals in the written specification and in the drawing figures indicate corresponding items.

DETAILED DESCRIPTION

Figure 2:
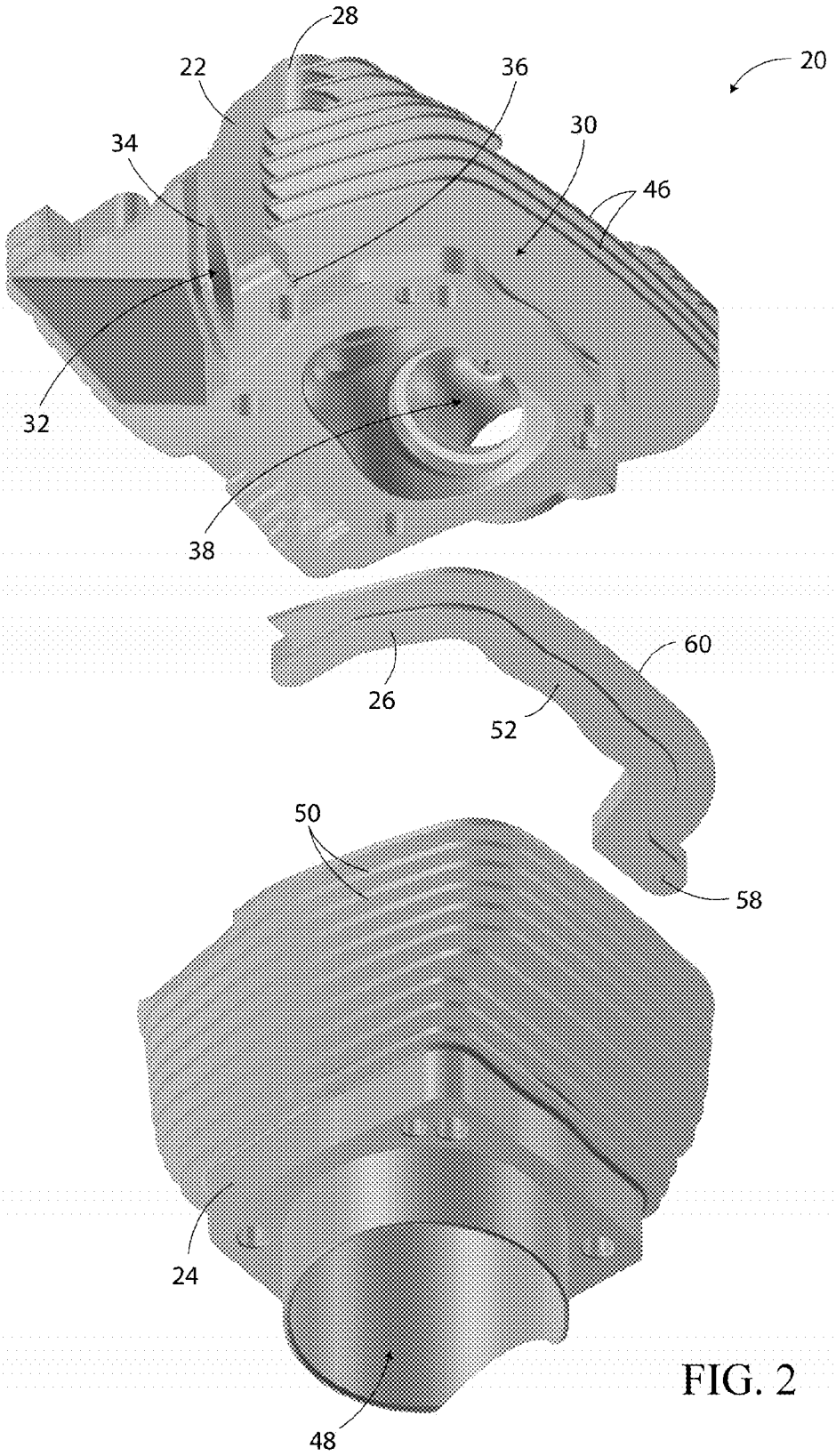
FIG. 2 is another assembly view of the embodiment of a cylinder assembly of FIG. 1 as viewed in perspective from beneath the cylinder assembly.
Figure 3:
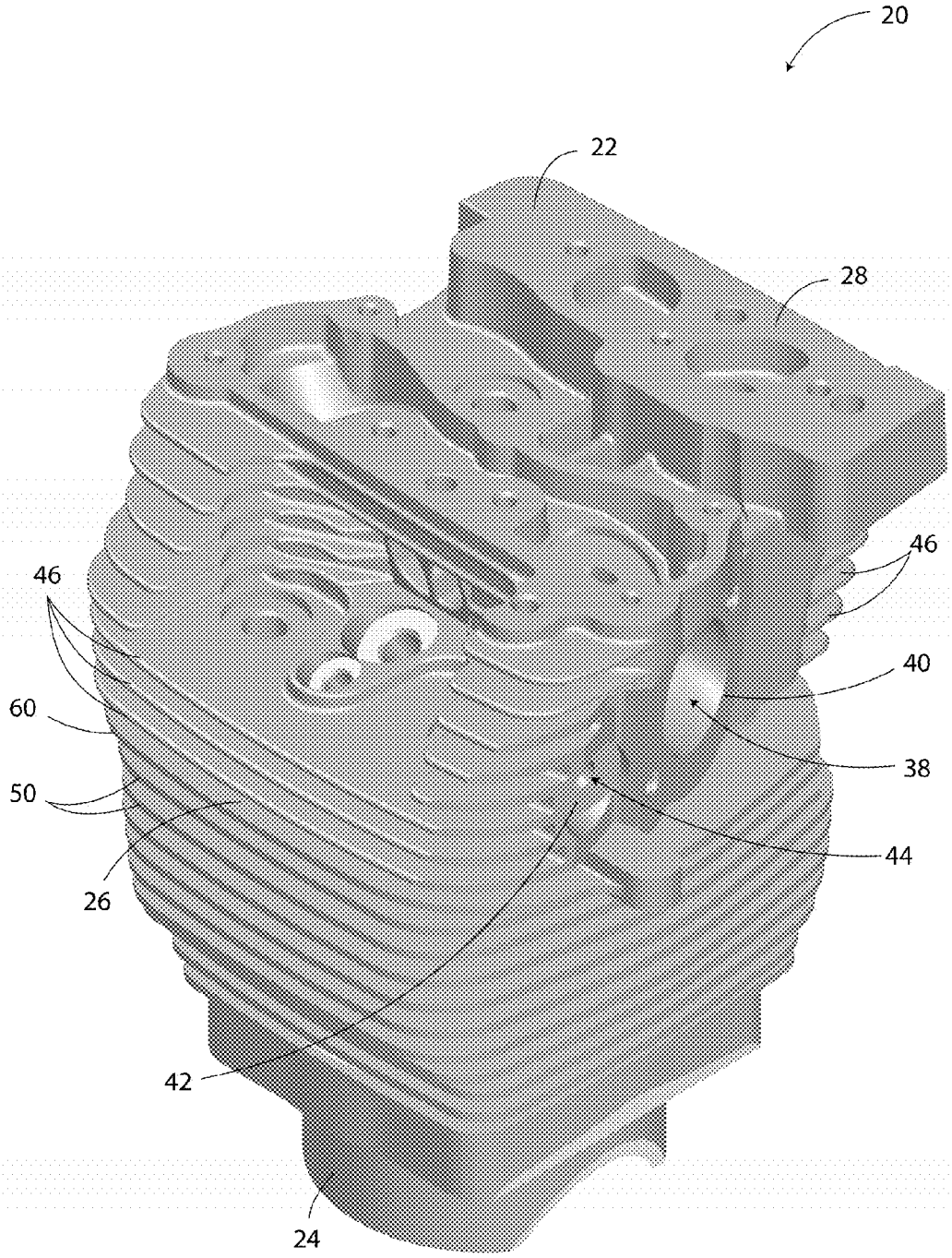
FIG. 3 is a perspective view of the cylinder assembly shown in FIGS. 1 and 2 in its assembled configuration.
Figure 6:
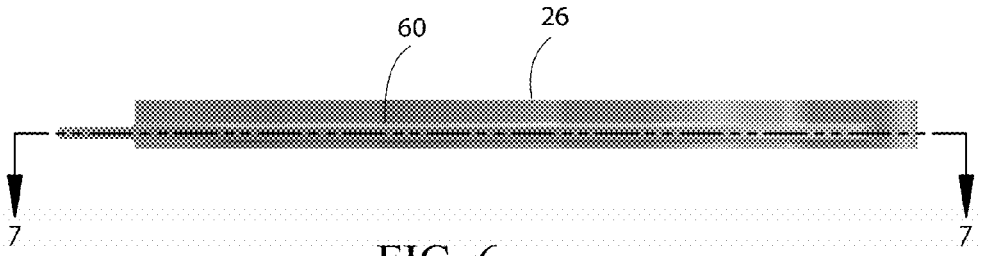
FIG. 6 is a side view of the EGR gas passageway member shown in FIGS. 1-3.

A preferred embodiment of motorcycle cylinder assembly 20 is shown in FIGS. 1-3. The cylinder assembly 20 preferably comprises a cylinder head 22, a cylinder 24, and an EGR gas passageway member 26. The EGR gas passageway member 26 preferably constitutes a portion of the cylinder head 22, but is preferably removable therefrom. In a similar manner, the EGR gas passageway member 26 could also constitute a portion of the cylinder 24 and be removable therefrom.

In view of the foregoing, the cylinder head 22 comprises a main body 28 that is configured to removably receive the EGR gas passageway member 26. More specifically, the main body 28 of the cylinder head 22 comprises a recess 30 which is configured to mate with the EGR gas passageway member 26 in a manner such that the bottom surfaces of the cylinder head and the EGR gas passageway member are coplanar. The main body 28 of the cylinder head 22 also comprises an exhaust chamber 32 that has primary 34 and secondary 36 output ports. The primary output port 34 is configured to connect to an exhaust assembly in a conventional manner. The secondary output port 36 is configured to operatively attach the exhaust chamber 32 to the EGR gas passageway member 26. The main body 28 of the cylinder head 22 further comprises an intake chamber 38 that has an intake port 40 and that is operatively connected to an EGR valve mount 42 via a gas passageway 44. Still further, the main body 28 of the cylinder head 22 comprises air cooling fins 46 to dissipate heat from the cylinder head and is preferably formed of an aluminum alloy for that same reason.

The cylinder 24 of the motorcycle cylinder assembly 20 is preferably a conventional cylinder comprising a cylinder bore 48 and plurality of air cooling fins 50. Like the main body 28 of the cylinder head 22, preferably at least the air cooling fins 50 of the cylinder 24 are formed of an aluminum alloy.

Figure 7:
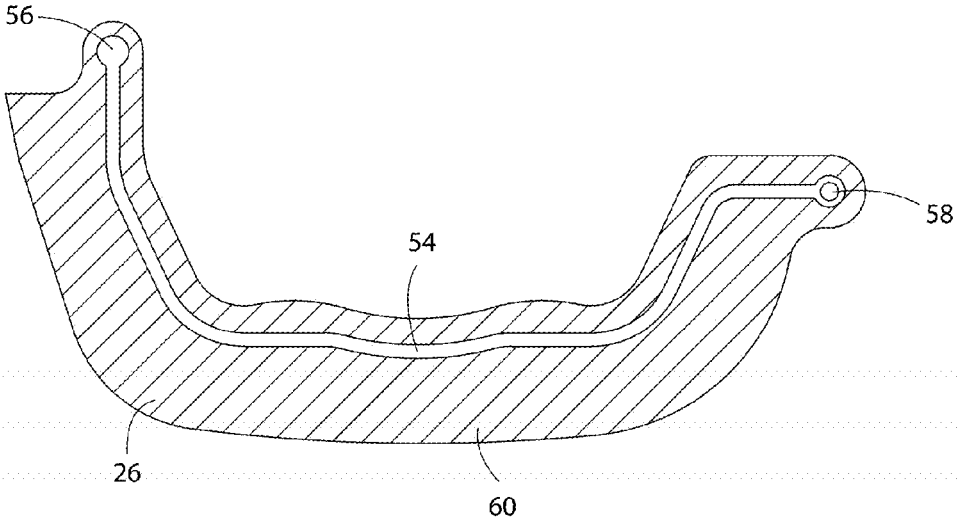
FIG. 7 is a cross-sectional view of the EGR gas passageway, taken about the line-7-7 shown in FIG. 6.

The EGR gas passageway member 26 comprises a main body 52 that is preferably formed out of a material, such as stainless steel, which has greater heat resistance than the aluminum alloy of the main body 28 of the cylinder head 22. As shown in FIG. 7, the main body 52 of the EGR gas passageway member 26 comprises an EGR gas passageway 54 that operatively connects an upward facing inlet port 56 of the main body 52 to a downward facing outlet port 58 of the main body. The EGR gas passageway member 26 preferably also comprises at least one air cooling fin 60. Preferably, the at least air cooling fin 60 is integrally formed with the main body 52 of the EGR gas passageway member 26.

The EGR gas passageway member 26 is preferably attached to the main body 28 of the cylinder head 22 via one or more bolts (not shown) or other removable fasteners. Optionally, a gasket can be provided between the upper surface of the EGR gas passageway member 26 and downward facing surface of the recess 30 of the main body 28 of the cylinder head 22. When attached to the main body 28 of the cylinder head 22, the inlet port 56 of the EGR gas passageway member 26 is aligned with the secondary outlet port 36 of the main body of the cylinder head and is thereby operatively connected thereto. The opposite end of the EGR gas passageway member 26 is preferably configured to protrude slightly from main body 28 of the cylinder head 22 to thereby allow an external connection to the outlet port 58 of the EGR gas passageway member to be made. Preferably, the outlet port 58 of the EGR gas passageway member 26 is operatively connected to the intake chamber 38 of the main body 28 of the cylinder head 22 through an EGR valve (not shown) such that the flow of exhaust gases through the EGR gas passageway 54 of the EGR gas passageway member can be more precisely controlled. The EGR valve mount 42 of the main body 28 of the cylinder head 22 is configured to at least partially support such an EGR valve.

With the EGR gas passageway member 26 and main body 28 of the cylinder head 22 attached to each other, the cylinder head is then attached to the cylinder 24 in a conventional manner via bolts. Once assembled as shown in FIG. 3, the EGR gas passageway member 26 cylinder assembly 20 becomes substantially concealed between the main body 28 of the cylinder head 22 and the cylinder 24. As shown, the air cooling fin 60 of the EGR gas passageway member 26 has an outer contour that is configured to match the outer contour of the adjacent air cooling fins of the main body 28 of the cylinder head 22 and the cylinder 24. Additionally, although not shown, the air cooling fin 60 of the EGR gas passageway member 26 may be capped via a material that conceals any discoloration of the EGR gas passageway member 26 resulting from exhaust gases passing therethrough.

In view of the foregoing, it should be appreciated that the invention provides for an aesthetically pleasing system for incorporating an EGR system into a motorcycle engine and is advantageous over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents. For example, although the EGR gas passageway member 26 preferably forms part of the cylinder head 22, it could alternatively be formed as part of the cylinder 24.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A motorcycle cylinder head, the motorcycle cylinder head comprising a plurality of aluminum alloy air cooling fins and a removable EGR gas passageway member, the EGR gas passageway member comprising an EGR passageway, the EGR gas passageway member being formed of an alloy having higher heat resistance than said aluminum alloy and being exposed to the environment external to the motorcycle cylinder head, the EGR gas passageway member being at least substantially concealed by appearing to be an integral part of the motorcycle cylinder head such that the presence of the EGR gas passageway member is not readily apparent.

2. A motorcycle cylinder head in accordance with claim 1 wherein the EGR gas passageway member comprises at least one air cooling fin that is parallel to the nearest one of the aluminum alloy air cooling fins.

3. A motorcycle cylinder head in accordance with claim 2 wherein the at least one air cooling fin of the EGR gas passageway member has a contour, and the nearest one of the aluminum alloy air cooling fins has a contour that is similar to the contour of the air cooling fin of the EGR gas passageway member.

4. A motorcycle cylinder head in accordance with claim 1 wherein the EGR gas passageway member comprises an intake port that is internal to the motorcycle cylinder head and the motorcycle cylinder head comprises an exhaust chamber, the exhaust chamber comprises primary and secondary output ports, the primary exhaust port is adapted and configured to connect to a motorcycle exhaust assembly, the secondary output port is internal to the motorcycle cylinder head and is operatively connected to the intake port of the EGR gas passageway member.

5. A motorcycle cylinder head in accordance with claim 4 wherein the EGR gas passageway member comprises an output port and the motorcycle cylinder head comprises an intake chamber, the intake chamber comprises an intake port and is operatively connected to an EGR valve mount, and the EGR valve mount is adapted and configured to at least partially support an EGR valve.

6. A motorcycle cylinder assembly comprising a cylinder and the motorcycle cylinder head of claim 1, the cylinder comprising a plurality of air cooling fins, the EGR gas passageway member being interfaced with the cylinder.

7. A motorcycle cylinder assembly in accordance with claim 6 wherein the EGR gas passageway member comprises at least one air cooling fin.

8. An EGR gas passageway member, the EGR gas passageway member comprising at least one air cooling fin and an EGR gas passageway formed of a single monolithic piece of material, the air cooling fin being parallel to the EGR gas passageway, the EGR gas passageway member being configured and adapted to be removably fixed to a motorcycle cylinder assembly comprising a cylinder and a cylinder head, the EGR gas passageway member being further configured and adapted to be positioned between the cylinder and the cylinder head.

9. A motorcycle cylinder assembly comprising a cylinder, a cylinder head, and the EGR gas passageway member of claim 8, the cylinder comprising a plurality of air cooling fins, the cylinder head comprising a plurality of air cooling fins, the EGR gas passageway member being removably fixed to at least one of the cylinder and the cylinder head, the cylinder head being removably fixed to the cylinder.

10. A motorcycle cylinder assembly in accordance with claim 9 wherein the air cooling fins of the cylinder head are formed of aluminum alloy and the EGR gas passageway member is formed of an alloy having higher heat resistance than said aluminum alloy.

11. A motorcycle cylinder assembly in accordance with claim 9 wherein the at least one air cooling fin of the EGR gas passageway member is between a nearest one of the air cooling fins of the cylinder head and a nearest one of the air cooling fins of the cylinder, and the at least one air cooling fin of the EGR gas passageway member and the nearest ones of the air cooling fins having similar contours.

* * * * *